US010087856B2

(12) United States Patent
Matsushita

(10) Patent No.: US 10,087,856 B2
(45) Date of Patent: Oct. 2, 2018

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Koki Matsushita, Miyoshi (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/617,466

(22) Filed: Jun. 8, 2017

(65) Prior Publication Data

US 2017/0356356 A1 Dec. 14, 2017

(30) Foreign Application Priority Data

Jun. 10, 2016 (JP) ..... 2016-116220

(51) Int. Cl.

| | |
|---|---|
| ***F02D 17/02*** | (2006.01) |
| ***F01L 13/00*** | (2006.01) |
| ***F02D 41/04*** | (2006.01) |
| ***F02D 41/06*** | (2006.01) |
| ***F02D 41/00*** | (2006.01) |

(Continued)

(52) U.S. Cl.

CPC ..... *F02D 17/02* (2013.01); *F01L 13/0005* (2013.01); *F02D 37/02* (2013.01); *F02D 41/0087* (2013.01); *F02D 41/042* (2013.01); *F02D 41/065* (2013.01);

(Continued)

(58) Field of Classification Search

CPC .. F02N 11/00; F02N 11/0818; F02N 11/0844; F02N 2300/00; F02N 11/0814; F02D 17/02; F02D 41/0087; F02D 41/123; F02D 41/126

USPC ..... 123/295, 305, 319–322, 325, 326, 430, 123/491, 481, 179.5, 179.1, 179.3, 179.4

See application file for complete search history.

(56) References Cited

U.S. PATENT DOCUMENTS

| | | | | |
|---|---|---|---|---|
| 6,588,397 | B1 | 7/2003 | Sieber | |
| 2001/0002379 | A1* | 5/2001 | Schechter | B60K 3/00 477/115 |

(Continued)

FOREIGN PATENT DOCUMENTS

| | | | |
|---|---|---|---|
| JP | 2003-515052 | A | 4/2003 |
| JP | 2004-301081 | A | 10/2004 |
| JP | 4207627 | B2 | 1/2009 |

*Primary Examiner* — John Kwon

(74) *Attorney, Agent, or Firm* — Hunton Andrews Kurth LLP

(57) ABSTRACT

An internal combustion engine includes cylinders that are divided into a first cylinder group and a second cylinder group, a cylinder reduction mechanism that holds intake valves and exhaust valves of the first cylinder group in closed states so as to establish a reduced-cylinder state. When the engine is stopped in the reduced-cylinder state, the electronic control unit provided in the engine starts the engine by ignition, by executing fuel injection and ignition in an expansion-stroke cylinder. When the first cylinder group includes an exhaust-stroke cylinder, the engine is started by ignition through fuel injection and ignition in the expansion-stroke cylinder, after a piston is moved in a reverse direction through fuel injection and ignition in the exhaust-stroke cylinder. When the first cylinder group does not include the exhaust-stroke cylinder, the engine is started by ignition, through fuel injection and ignition in the expansion-stroke cylinder and an intake-stroke cylinder.

3 Claims, 7 Drawing Sheets

(51) Int. Cl.
*F02N 19/00* (2010.01)
*F02N 99/00* (2010.01)
*F02D 37/02* (2006.01)

(52) U.S. Cl.
CPC ..... *F02N 19/005* (2013.01); *F02N 99/006* (2013.01); *F01L 2013/001* (2013.01); *F02D 2041/0012* (2013.01)

(56) References Cited

U.S. PATENT DOCUMENTS

2004/0060530 A1* 4/2004 Mitani ..... F02N 11/08 123/179.3
2006/0081207 A1* 4/2006 Nakamura ..... F01L 13/0026 123/179.3
2007/0062476 A1* 3/2007 Ota ..... F02B 23/104 123/179.4
2012/0125298 A1* 5/2012 Lemke ..... F01B 7/14 123/51 B
2017/0138286 A1* 5/2017 Kojima ..... F02D 41/042

* cited by examiner

CONTROL DEVICE FOR INTERNAL COMBUSTION ENGINE

CROSS-REFERENCE TO RELATED APPLICATIONS

This application claims priority to Japanese Patent Application No. 2016-116220 filed on Jun. 10, 2016, which is incorporated herein by reference in its entirety.

BACKGROUND

1. Technical Field

The disclosure relates to an internal combustion engine, and more particularly to a control device of an internal combustion engine that can be started by ignition, from a condition where the engine is stopped.

2. Description of Related Art

In Japanese Patent Application Publication No. 2004-301081 (JP 2004-301081 A), a technology concerning so-called ignition starting executed by a starting system that automatically restarts an engine after once stopping the engine during idling, for example, is disclosed. The ignition starting is executed by supplying fuel to a particular cylinder of the engine that is in a stopped state, and igniting and burning the fuel, so as to start the engine by using energy of the combustion. More specifically, according to this technology, each exhaust valve of a cylinder that is on the exhaust stroke when the engine is stopped is placed in a closed state when the engine is restarted, and the fuel is supplied to the cylinder and forced ignition is executed, so that the piston is moved in the reverse direction. As a result, the pressure in a cylinder that is on the expansion stroke when the engine is stopped is increased, so that driving force for rotating the engine in the positive direction can be obtained, through ignition and combustion in the cylinder that is on the expansion stroke.

SUMMARY

According to the technology of JP 2004-301081 A, the exhaust valve of the cylinder that is on the exhaust stroke when the engine is stopped needs to be placed in the closed state. Therefore, in order to execute ignition starting with the above technology, the hard configuration for making the exhaust valves of all of the cylinders freely operable or operable as desired is needed. Since the provision of the special hard configuration for ignition starting has a problem in its feasibility, including cost, it is desired to construct a system that executes ignition starting, using known hard configuration.

The disclosure has been developed in view of the above problem, and provides an internal combustion engine, which is able to start the engine by ignition from a condition where the engine is stopped, without requiring exhaust valves of all cylinders to be configured to be freely operable.

According to one aspect of the disclosure, a control device for an internal combustion engine including a plurality of cylinders, a fuel injection device, an ignition device, a cylinder reduction mechanism is provided. The plurality of cylinders are divided into a first cylinder group and a second cylinder group. The first cylinder group includes cylinders of which ignition orders are not next to each other, and the second cylinder group includes cylinders of which ignition orders are not next to each other. The fuel injection device is configured to execute fuel injection in each of the plurality of cylinders. The ignition device is configured to execute ignition in each of the plurality of cylinders. The cylinder reduction mechanism is configured to hold intake valves and exhaust valves of the first cylinder group in closed states so as to establish a reduced-cylinder state. The control device comprises an electronic control unit. The electronic control unit is configured to: (i) execute reduced-cylinder operation by halting fuel injection and ignition in the cylinders of the first cylinder group in the reduced-cylinder state during operation of the internal combustion engine, (ii) start the internal combustion engine by ignition, by executing fuel injection and ignition in an expansion-stroke cylinder as a cylinder on an expansion stroke, when the internal combustion engine is stopped in the reduced-cylinder state, and (iii) when the first cylinder group includes an exhaust-stroke cylinder as a cylinder on an exhaust stroke when the internal combustion engine is started by ignition, execute fuel injection and ignition in the expansion-stroke cylinder, after moving a piston in a reverse direction through fuel injection and ignition in the exhaust-stroke cylinder, and cancel the reduced-cylinder state, so as to start the internal combustion engine by ignition; and (iv) when the first cylinder group does not include the exhaust-stroke cylinder, move the piston in a positive direction through fuel injection and ignition in the expansion-stroke cylinder and a cylinder on an intake stroke of the first cylinder group, and then cancel the reduced-cylinder state, so as to start the internal combustion engine by ignition.

According to the control device for the internal combustion engine of the disclosure as described above, when the internal combustion engine that is stopped in the reduced-cylinder state is restarted, and the exhaust-stroke cylinder as the cylinder on the exhaust stroke is included in the first cylinder group, the piston is moved in the reverse direction by energy produced by combustion in the exhaust-stroke cylinder. As a result, the pressure in the expansion-stroke cylinder that is on the expansion stroke is increased, so that the engine can be reliably started by ignition due to energy produced by the subsequent combustion of the expansion-stroke cylinder. On the other hand, when the internal combustion engine that is stopped in the reduced-cylinder state is restarted, and the exhaust-stroke cylinder is not included in the first cylinder group, the fuel is burned in the cylinder on the intake stroke, out of the first cylinder group, at the same time that the fuel is burned in the expansion-stroke cylinder as the cylinder on the expansion stroke. As a result, even when the pressure in the expansion-stroke cylinder is low, the engine can be reliably started by ignition, using explosion torque of the cylinder on the intake stroke. Thus, according to the disclosure, the internal combustion engine can be started by ignition, by utilizing the reduced-cylinder state established by the cylinder reduction mechanism; therefore, it is possible to start the engine by ignition from a condition where the engine is stopped, without requiring exhaust valves of all of the cylinders to be configured to be freely operable.

Also, in the control device for the internal combustion engine as described above, the electronic control unit may be configured to execute fuel injection and ignition in the expansion-stroke cylinder, after moving the piston of the expansion-stroke cylinder to a position corresponding to a reference crank angle, through fuel injection and ignition in the exhaust-stroke cylinder, when the electronic control unit determines that the exhaust-stroke cylinder is included in the first cylinder group.

According to the configuration of the control device for the internal combustion engine as described above, when the engine that is stopped in the reduced-cylinder state is restarted, and the exhaust-stroke cylinder that is on the exhaust stroke is included in the first cylinder group, the piston is moved in the reverse direction due to energy produced by combustion in the exhaust-stroke cylinder, and the fuel is burned in the expansion-stroke cylinder, after the piston of the expansion-stroke cylinder is moved to the position corresponding to the reference crank angle. With this arrangement, the pressure in the expansion-stroke cylinder can be increased to a target pressure level, so that the engine can be reliably started by ignition.

Further, in the control device for the internal combustion engine, the electronic control unit may be configured to: (i) automatically stop operation of the internal combustion engine when an automatic stop condition is satisfied during operation of the internal combustion engine, and (ii) stop the internal combustion engine after switching the internal combustion engine to operation in the reduced-cylinder state, when the internal combustion engine is not in the reduced-cylinder state when the automatic stop condition is satisfied.

According to the configuration of the control device for the internal combustion engine as described above, when the engine is not in the reduced-cylinder state when the automatic stop condition is satisfied during operation of the engine, the engine is stopped after it is switched to the reduced-cylinder state. With this arrangement, even when the automatic stop condition is satisfied while the engine is not operating in the reduced-cylinder state, the engine can be stopped in a condition where the intake valves and exhaust valves of the first cylinder group are in closed states.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Some embodiments of the disclosure will be described with reference to the drawings. It is, however, to be understood that, when numbers, such as the number of pieces of each element, numerical quantity, amount, and range, are mentioned in the description of the embodiments below, this disclosure is not limited to the numbers thus mentioned, except for the case where the numbers are particularly clearly specified or apparently specified in principle. Also, the structures, steps, etc. described in the embodiments below are not necessarily essential to this disclosure, except for the case where they are particularly clearly specified or apparently specified in principle.

Figure 1:
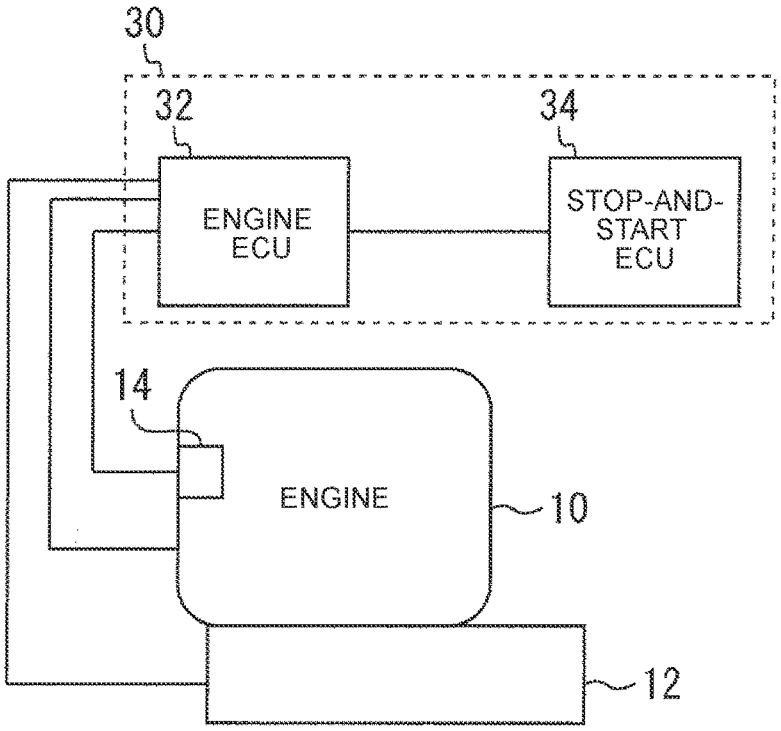
FIG. 1 is a view showing the general configuration of a system of a first embodiment of the disclosure.

A first embodiment of the disclosure will be described with reference to the drawings. FIG. 1 is a view showing the general configuration of a system of the first embodiment. The system shown in FIG. 1 includes an internal combustion engine (which will also be simply called "engine") 10. The engine 10 is a four-cylinder engine in which four cylinders are arranged in series. In the following description, respective cylinders of the engine 10 will be called first cylinder #1, second cylinder #2, third cylinder #3, and fourth cylinder #4 in the order of arrangement of the cylinders. Out of these cylinders, the first cylinder #1 of the first ignition order and the fourth cylinder #4 of the third ignition order constitute a first cylinder group. The second cylinder #2 of the fourth ignition order and the third cylinder #3 of the second ignition order constitute a second cylinder group. Namely, each of the first cylinder group and the second cylinder group consists of two or more cylinders whose ignition times are not next to each other.

In the first embodiment, the engine 10 shown in FIG. 1 is constructed as a spark ignition type, in-cylinder direct injection engine, and an ignition plug and an in-cylinder injection valve (not shown) are mounted in each cylinder. Also, the first cylinder group of the engine 10 is provided with a cylinder reduction mechanism 12 that can halt operation of the cylinders by making the lifts amount of intake valves and exhaust valves equal to zero. The cylinder reduction mechanism 12 may be in the form of a mechanism that provides camshafts with sliding mechanisms so as to switch cams between those for use in cylinder reduction mode and those for use in normal mode, for example. When the lift amounts of the intake valves and exhaust valves are equal to zero, fuel injection and ignition are both stopped in these cylinders.

Figures 2A, 2B:
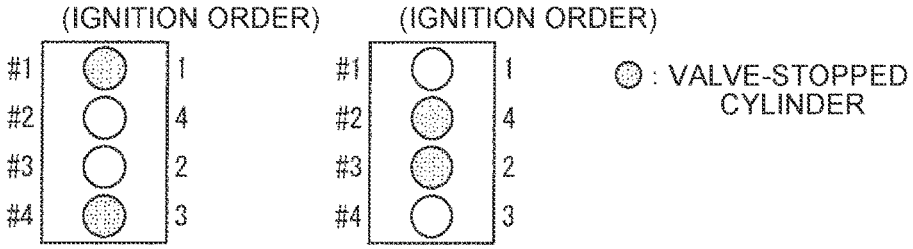
FIG. 2A is a view showing an example in which a first cylinder group is provided with a cylinder reduction mechanism in an engine included in the system.
FIG. 2B is a view showing an example in which a second cylinder group is provided with a cylinder reduction mechanism in the engine included in the system.

The cylinder reduction mechanism 12 may also be provided for the second cylinder group. FIG. 2A and FIG. 2B are views each showing an example of cylinder group for which the cylinder reduction mechanism is provided. FIG. 2A shows an example in which the cylinder reduction mechanism 12 is provided for the first cylinder group. FIG.

2B shows an example in which the cylinder reduction mechanism 12 is provided for the second cylinder group. The cylinders of the cylinder group provided with the cylinder reduction mechanism 12 can be placed in a valve-stopped state where the intake valves and the exhaust valves are in closed states. In the following description, an operating mode in which the intake valves and exhaust valves of a part of cylinders are in the closed states and stopped by operation of the cylinder reduction mechanism 12 will be called "reduced-cylinder operation", and the cylinders whose valves are stopped by operation of the cylinder reduction mechanism 12 will be called "valve-stopped cylinders", while the cylinders whose valves are not stopped by operation of the cylinder reduction mechanism 12 will be called "non-valve-stopped cylinders".

The engine 10 constructed as described above is controlled by a control device 30. The control device 30 is an ECU (Electronic Control Unit). The control device 30 consists of an engine ECU 32 for engine control, and a stop-and-start ECU 34 for reversing stop and start of the engine 10, and the engine ECU 32 and the stop-and-start ECU 34 are connected via a communication line. The control device 30 has at least an input/output interface, ROM, RAM, and CPU. The input/output interface is provided for receiving sensor signals from various sensors mounted in the engine 10 and the vehicle, and generating operation signals to actuators included in the engine 10. The sensors from which the control device 30 receives signals include an air flow meter, air-fuel ratio sensor, accelerator pedal position sensor, and so forth, as well as a crank angle sensor 14 capable of detecting the rotational angle and rotational direction of the crankshaft. The actuators to which the control device 30 generates operation signals include ignition devices (not shown), fuel injection devices (not shown), and so forth, as well as the cylinder reduction mechanism 12. Various control programs and maps used for controlling the engine 10 are stored in the ROM. The CPU reads the control programs from the ROM, and creates the operation signals based on the received sensor signals.

Next, operation of the first embodiment will be described. Initially, the reduced-cylinder operation will be described. The control programs executed by the control device 30 include a control program for reduced-cylinder operation. The reduced-cylinder operation of the engine 10 is accomplished by establishing a reduced-cylinder state in which the intake valves and exhaust valves of the cylinders (valve-stopped cylinders) of the first cylinder group are placed in the closed states and stopped by the cylinder reduction mechanism 12, and stopping fuel injection into the valve-stopped cylinders and ignition, so as to halt operation of these two cylinders. As a result, the number of cylinders in operation of the engine 10 is reduced from four cylinders to two cylinders. With the number of cylinders in operation thus reduced from four cylinders to two cylinders through the reduced-cylinder operation, the charging efficiency per cylinder, which is required for obtaining equal torque, is increased. If the charging efficiency is increased, a pump loss of the cylinders in operation is reduced, and the thermal efficiency of the engine as a whole is improved. As a result, the fuel economy is improved by executing the reduced-cylinder operation. The operating range in which the reduced-cylinder operation is executed is determined in a map using load torque and engine speed, for example, as parameters.

Next, idle stop control of the engine 10 will be described. The control programs executed by the control device 30 include a control program for idle stop control. Under the idle stop control, when automatic stop conditions are satisfied during operation of the engine 10, operation of the engine 10 is automatically stopped, for improvement of the fuel economy. The automatic stop conditions include conditions that the acceleration depression amount is equal to "0", that the vehicle speed is equal to "0", and that the brake pedal is depressed (operated to ON), for example. Also, under the idle stop control, when automatic start conditions are satisfied while operation of the engine 10 is being stopped under the idle stop control, the engine 10 is automatically started. The automatic start conditions include conditions that the acceleration depression amount becomes larger than "0", and that the brake pedal is released (i.e., operated to OFF), for example. The stop-and-start ECU 34 of the control device 30 determines whether the automatic stop conditions are satisfied, and whether the automatic start conditions are satisfied.

When the engine 10 is started from a condition where operation of the engine 10 is stopped under the idle stop control, ignition starting is executed. Since the cylinder on the expansion stroke is in a condition where the intake valve(s) and the exhaust valve(s) are closed, the expansion-stroke cylinder is hermetically closed. Therefore, if fuel injection and ignition are executed in the expansion-stroke cylinder, during stop of operation of the engine 10, explosion torque can be generated.

However, the explosion torque generated in the expansion-stroke cylinder may not be large enough to start the engine 10. Namely, when operation of the engine 10 is stopped, the piston of each cylinder is normally stopped at around an intermediate position between the top dead center and the bottom dead center because of the balance of the cylinders. In this case, since the pressure in the expansion-stroke cylinder as the cylinder that is on the expansion stroke during stop of the engine 10 is relatively low, the expansion-stroke cylinder may not be able to produce explosion torque to such an extent that the compression-stroke cylinder as the cylinder on the compression stroke goes beyond the compression top dead center. In order to prevent this problem of ignition starting, ignition start control as described below is executed when ignition starting is executed from a condition where operation of the engine 10 is stopped.

Next, the ignition start control of the engine 10 will be described. The control programs executed by the control device 30 include a control program for ignition start control. The control device 30 executes the control program for ignition start control, so as to function as an ignition starting device. Under the ignition start control, when the engine 10 is started by ignition, from a condition where operation of the engine 10 is stopped in the reduced-cylinder state, and the exhaust-stroke cylinder as the cylinder on the exhaust stroke is included in the valve-stopped cylinders (namely, the cylinders of the first cylinder group) in the reduced-cylinder state, the engine 10 is started by ignition, using explosion torque of the exhaust-stroke cylinder and the expansion-stroke cylinder.

Figure 3:
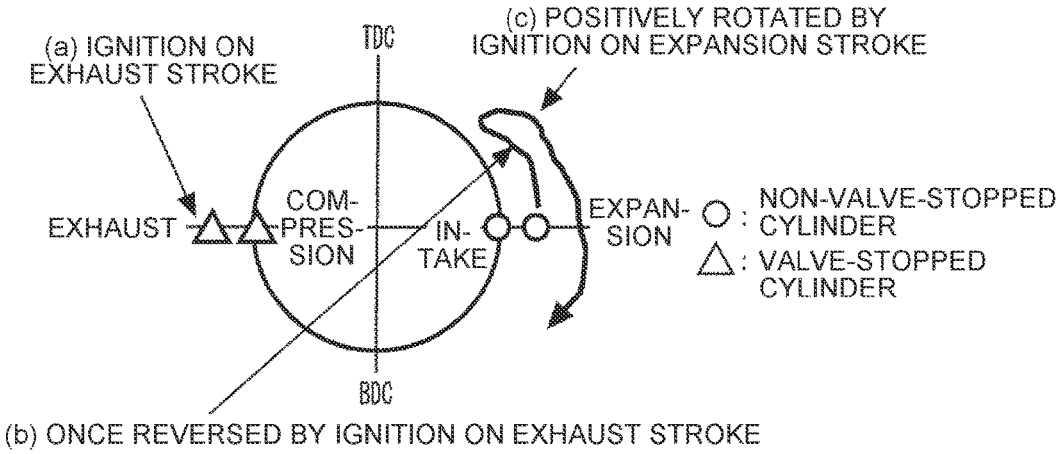
FIG. 3 is a view useful for explaining an ignition starting method when an exhaust-stroke cylinder is included in valve-stopped cylinders in a reduced-cylinder state of the engine.
Figure 4:
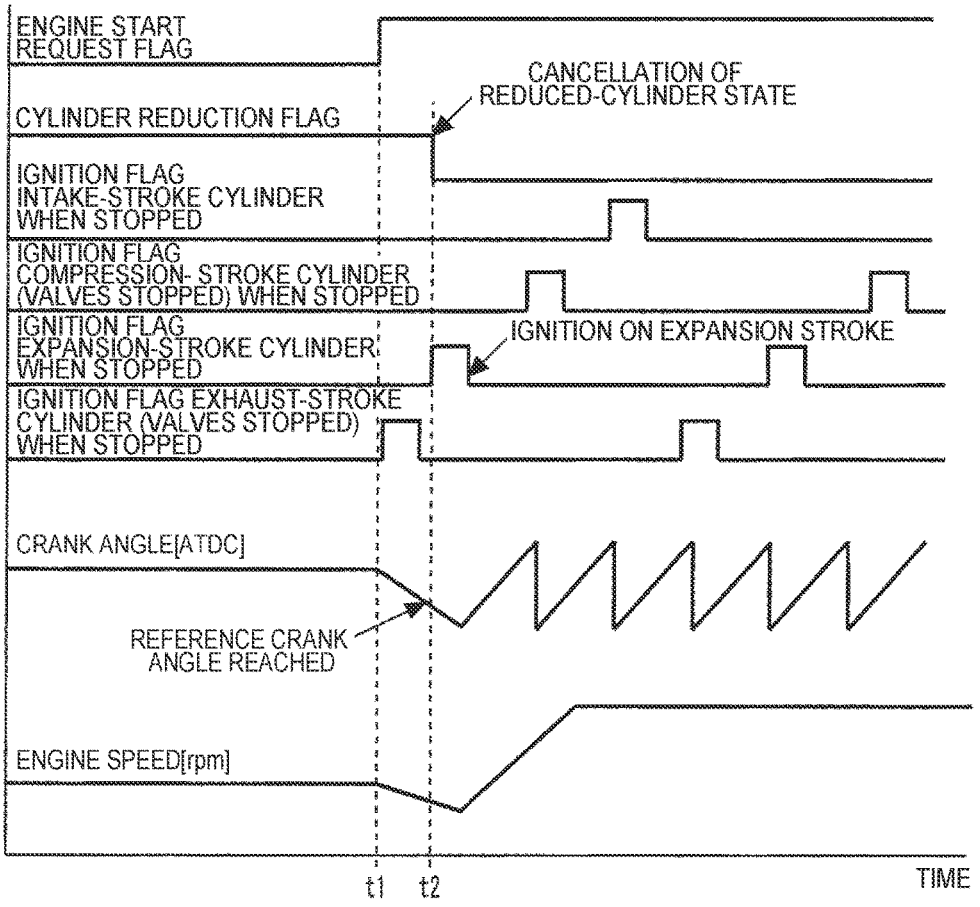
FIG. 4 is a time chart useful for explaining the ignition starting method when the exhaust-stroke cylinder is included in the valve-stopped cylinders in the reduced-cylinder state.

FIG. 3 is a view useful for explaining an ignition starting method in the case where the exhaust-stroke cylinder is included in the valve-stopped cylinders in the reduced-cylinder state. FIG. 4 is a time chart useful for explaining the ignition starting method in the case where the exhaust-stroke cylinder is included in the valve-stopped cylinders in the reduced-cylinder state. In the example shown in FIG. 3, the valve-stopped cylinders include the exhaust-stroke cylinder and the compression-stroke cylinder. Therefore, at time t1 at which the automatic start conditions are satisfied and an engine start request flag is set to ON, the control device 30 executes fuel injection and ignition in the exhaust-stroke cylinder that is in the hermetically closed state ((a) in FIG. 3). If explosion torque is generated in the exhaust-stroke cylinder, force is applied to the piston in such a direction as to press down the piston (i.e., in a direction opposite to the direction of movement of the piston on the exhaust stroke). As a result, the crankshaft of the engine 10 once rotates in the reverse direction, so that the piston of the expansion-stroke cylinder moves toward the compression top dead center (TDC) ((b) in FIG. 3). Then, at time t2 at which the crank angle reaches a reference crank angle, the control device 30 executes fuel injection and ignition in the expansion-stroke cylinder, and sets a cylinder reduction flag to OFF so as to cancel the reduced-cylinder state. For example, the reference crank angle is set to a crank angle at which the piston of the expansion-stroke cylinder is located at a position in the vicinity of the compression top dead center (TDC) on the expansion stoke. If explosion torque is generated in the expansion-stroke cylinder, force is applied to the piston in such a direction as to press down the piston, and the crankshaft of the engine 10 is reversed to rotate in the positive direction ((c) in FIG. 3). At this time, large explosion torque can be generation in the expansion-stroke cylinder, due to increase of the pressure in the cylinder, so that the engine 10 can be reliably started by ignition.

On the other hand, under the ignition start control, when the engine 10 is started by ignition, from a condition where operation of the engine 10 is stopped in the reduced-cylinder state, and the exhaust-stroke cylinder is not included in the valve-stopped cylinders (namely, the cylinders of the first cylinder group) in the reduced-cylinder state, the engine 10 is started by ignition, using explosion torque of an intake-stroke cylinder as a cylinder that is on the intake stroke during stop of the engine 10, and the expansion-stroke cylinder.

Figure 5:
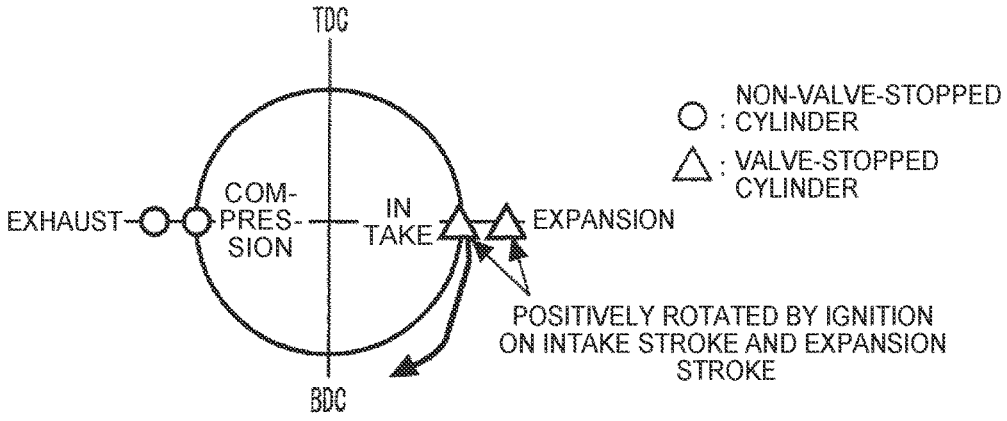
FIG. 5 is a view useful for explaining an ignition starting method when the exhaust-stroke cylinder is not included in the valve-stopped cylinders in the reduced-cylinder state.
Figure 6:
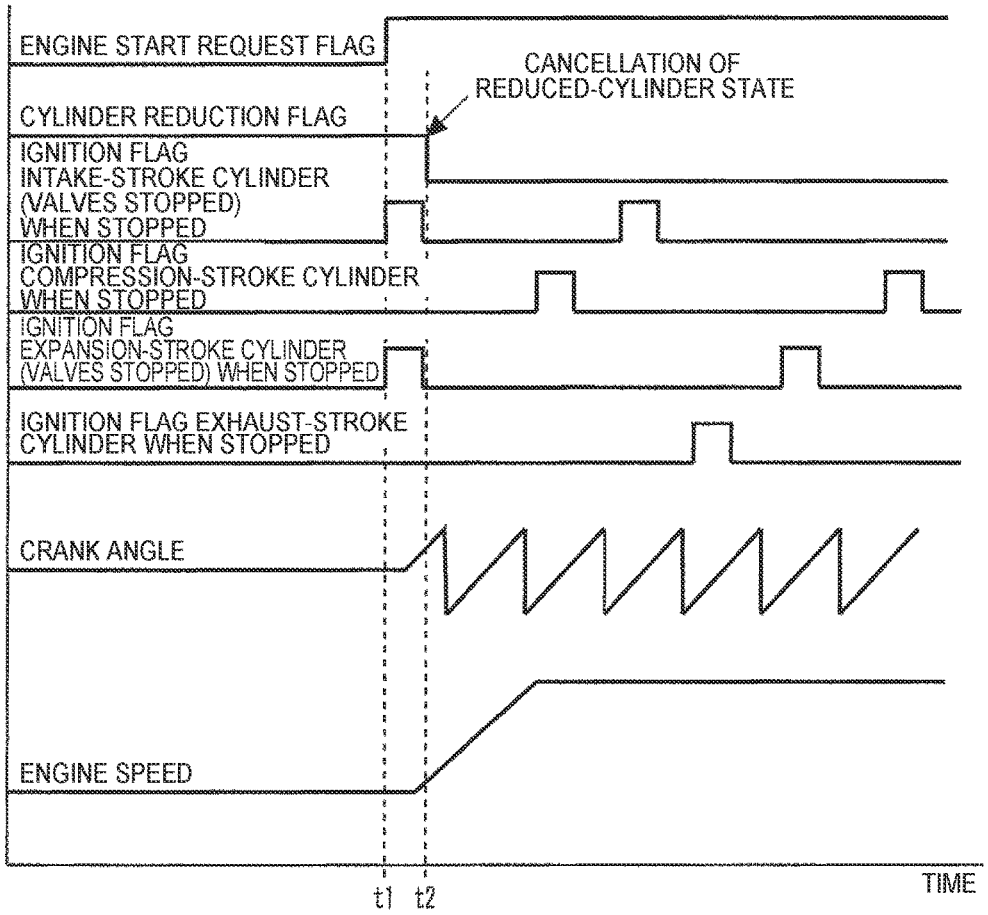
FIG. 6 is a view useful for explaining the ignition starting method when the exhaust-stroke cylinder is not included in the valve-stopped cylinders in the reduced-cylinder state.

FIG. 5 is a view useful for explaining an ignition starting method in the case where the exhaust-stroke cylinder is not included in the valve-stopped cylinders in the reduced-cylinder state. FIG. 6 is a time chart useful for explaining the ignition starting method in the case where the exhaust-stroke cylinder is not included in the valve-stopped cylinders in the reduced-cylinder state. In the example shown in FIG. 5, since the exhaust-stroke cylinder is not included in the valve-stopped cylinders, the pressure in the expansion-stroke cylinder cannot be increased by rotating the crankshaft of the engine 10 in the reverse direction. Therefore, at time t1 at which the automatic start conditions are satisfied and the engine start request flag is set to ON, the control device 30 executes fuel injection and ignition in both of the intake-stroke cylinder and expansion-stroke cylinder that are in the hermetically closed states. If explosion torque is generated in the intake-stroke cylinder and the expansion-stroke cylinder, force is applied to the pistons in the two cylinders, in such directions as to press down the pistons. As a result, at time t2, the crankshaft of the engine 10 rotates in the positive direction, and the cylinder reduction flag is set to OFF so that the reduced-cylinder state is cancelled. If explosion takes place at the same time in the intake-stroke cylinder and the expansion-stroke cylinder, large explosion torque can be generated, and therefore, the engine 10 can be reliably started by ignition.

Figure 7:
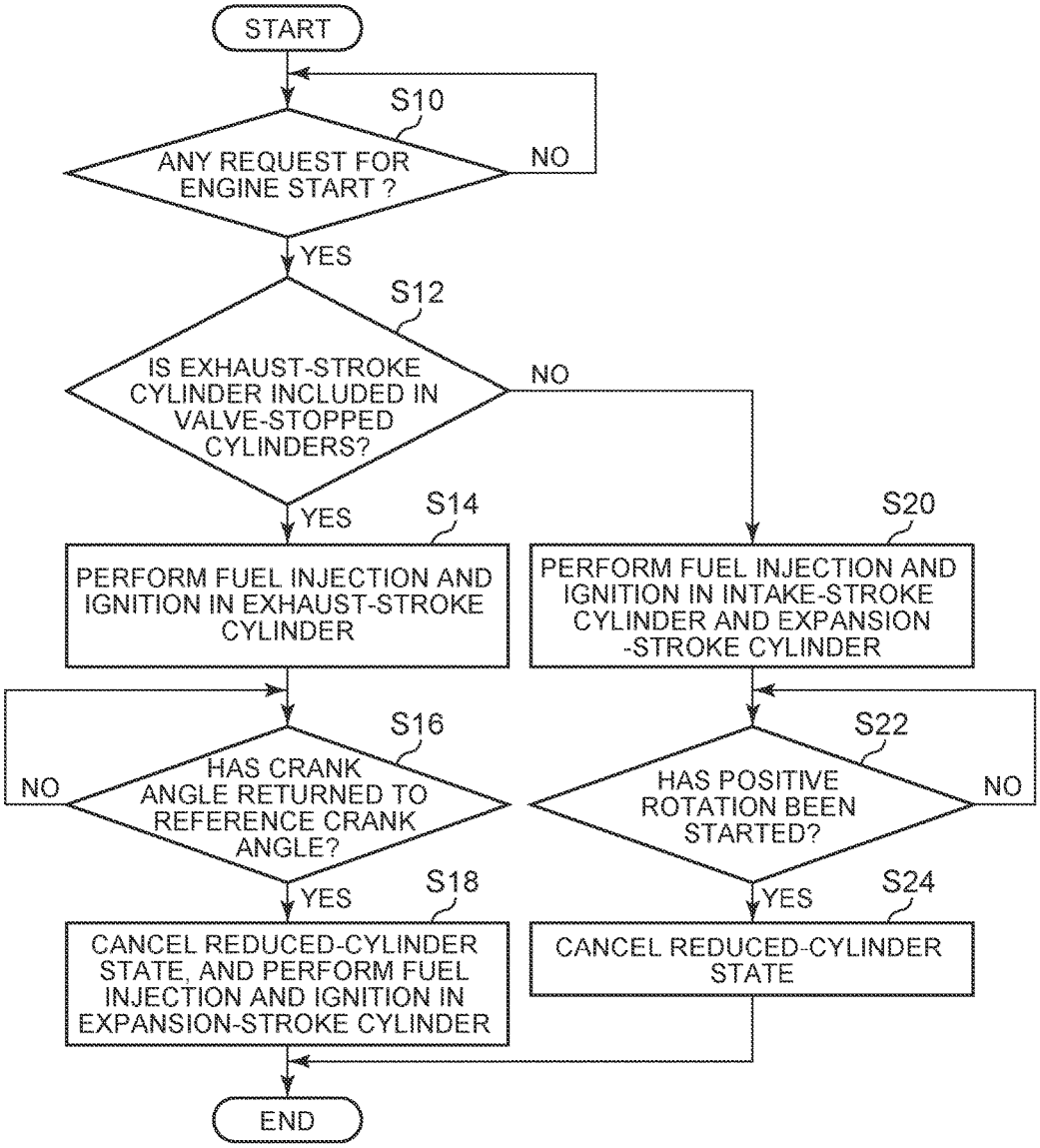
FIG. 7 is a flowchart illustrating a control routine executed by a control device (electronic control unit) included in the engine in the first embodiment.

Next, specific processing of the first embodiment will be described. Referring to FIG. 7, specific processing of the ignition start control executed by the system of the first embodiment will be described. FIG. 7 is a flowchart illustrating a control routine executed by the control device 30 of the first embodiment. The routine shown in FIG. 7 is executed when the engine 10 is in the reduced-cylinder state, and its operation is stopped under idle stop control.

In the control routine shown in FIG. 7, it is initially determined whether a request for starting the engine 10 is generated (step S10). In this step, it is determined whether the automatic start conditions for automatically starting the engine 10 from a condition where the engine 10 is stopped under idle stop control are satisfied, and the engine start request flag is set to ON. As a result, if a negative decision (NO) is obtained in step S10, step S10 is repeatedly executed until an affirmative decision (YES) is obtained in step S10.

On the other hand, if an affirmative decision (YES) is obtained in step S10, the control proceeds to the next step, in which it is determined, using an output signal of the crank angle sensor 14, whether the exhaust-stroke cylinder is included in the valve-stopped cylinders (step S12). As a result, if it is determined that the exhaust-stroke cylinder is included in the valve-stopped cylinders, the control proceeds to the next step, in which fuel injection and ignition are executed in the exhaust-stroke cylinder (step S14).

Next, it is determined whether the crank angle has returned to the reference crank angle (step S16). As a result, if a negative decision (NO) is obtained in step S16, step S16 is repeatedly executed until an affirmative decision (YES) is obtained in step S16. On the other hand, if an affirmative decision (YES) is obtained in step S16, it is determined that explosion torque needed for ignition starting can be produced in the expansion-stroke cylinder, and the control proceeds to the next step, in which the reduced-cylinder state is cancelled, and fuel injection and ignition are executed in the expansion-stroke cylinder (step S18).

On the other hand, if it is determined in the above step S12 that the exhaust-stroke cylinder is not included in the valve-stopped cylinders, the control proceeds to the next step, in which fuel injection and ignition are executed in the intake-stroke cylinder and the expansion-stroke cylinder (step S20). Then, it is determined whether positive rotation of the crankshaft has been started (step S22). As a result, if a negative decision (NO) is obtained in step S22, step S22 is repeatedly executed until an affirmative decision (YES) is obtained in step S22. Then, if an affirmative decision (YES) is obtained in step S22, the control proceeds to the next step, in which the reduced-cylinder state is cancelled (step S24).

Thus, according to the system of the first embodiment, it is possible to reliably start the engine 10 by ignition, from a condition where operation of the engine 10 is stopped in the reduced-cylinder state.

While the system of the first embodiment of the disclosure has been described above, the system of the first embodiment may be modified as follows.

Figure 8A:
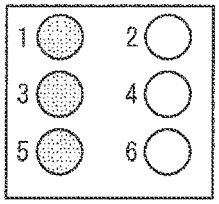
FIG. 8A is a view showing an example in which a first cylinder group is provided with a cylinder reduction mechanism, in a V-type six-cylinder engine.
Figure 8B:
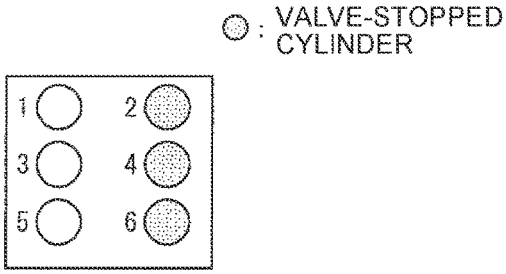
FIG. 8B is a view showing an example in which a second cylinder group is provided with a cylinder reduction mechanism, in a V-type six-cylinder engine.

The engine 10 may have a left bank and a right bank, and may be constructed as a V-type, six-cylinder engine in which three cylinders are located in each bank. Each of FIG. 8A and FIG. 8B shows an example of a cylinder group provided with a cylinder reduction mechanism in the V-type six-cylinder engine. In the following description, first cylinder #1, third cylinder #3, and fifth cylinder #5 located in the left bank of the engine 10 constitute a first cylinder group, and second cylinder #2, fourth cylinder #4, and sixth cylinder #6 located in the right bank constitute a second cylinder group. In FIGS. 8A and 8B, the cylinder number of each of the cylinders is the same as the ignition order.

FIG. 8A shows an example in which the cylinder reduction mechanism 12 is provided for the first cylinder group. FIG. 8B shows an example in which the cylinder reduction mechanism 12 is provided for the second cylinder group.

Thus, the cylinder reduction mechanism 12 may be provided for either one of the first cylinder group and the second cylinder group.

Figure 9:
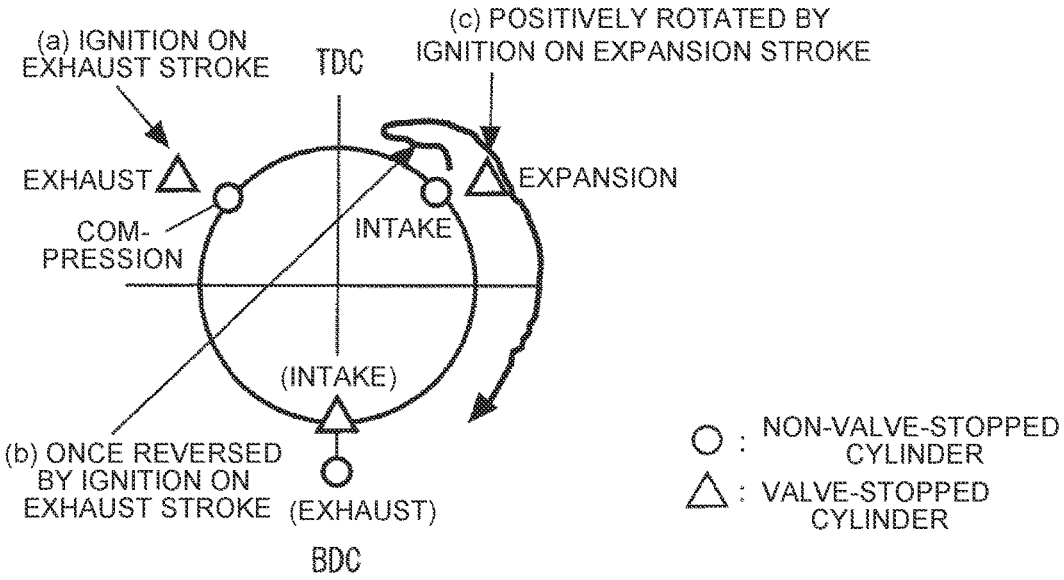
FIG. 9 is a view useful for explaining an ignition starting method when an exhaust-stroke cylinder is included in valve-stopped cylinders in a reduced-cylinder state, when the engine is the V-type six-cylinder engine.

Even where the engine 10 is constructed as the V-type six-cylinder engine as described above, ignition start control similar to that in the case of the four-cylinder engine can be applied. FIG. 9 is a view useful for explaining an ignition starting method in the case where an exhaust-stroke cylinder is included in valve-stopped cylinders of the V-type six-cylinder engine that is in the reduced-cylinder state. In the example shown in FIG. 9, the valve-stopped cylinders include the exhaust-stroke cylinder and an expansion-stroke cylinder. Therefore, when the automatic start conditions are satisfied, the control device 30 executes fuel injection and ignition in the exhaust-stroke cylinder that is in the hermetically closed state. As a result, the pressure in the expansion-stroke cylinder can be increased, so that large explosion torque can be generated, and the engine 10 can be reliably started by ignition.

Figure 10:
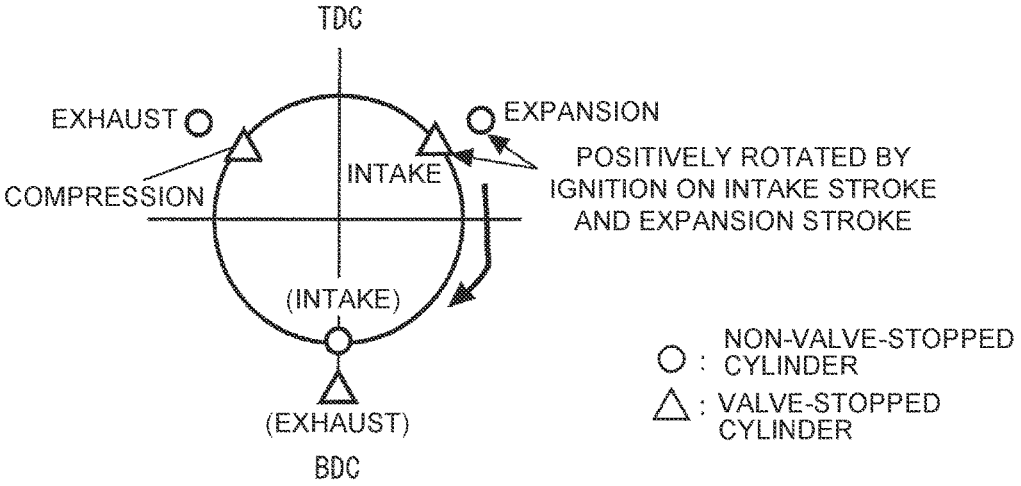
FIG. 10 is a view useful for explaining an ignition starting method when the exhaust-stroke cylinder is not included in the valve-stopped cylinders in the reduced-cylinder state, when the engine is the V-type six-cylinder engine.

FIG. 10 is a view useful for explaining an ignition starting method in the case where the exhaust-stroke cylinder is not included in the valve-stopped cylinders of the V-type six-cylinder engine that is in the reduced-cylinder state. In the example shown in FIG. 10, the exhaust-stroke cylinder is not included in the valve-stopped cylinders. Therefore, when the automatic start conditions are satisfied, the control device 30 executes fuel injection and ignition on both of the intake-stroke cylinder and expansion-stroke cylinder that are in the hermetically closed states. As a result, large explosion torque can be generated, and therefore, the engine 10 can be reliably started by ignition.

Next, a second embodiment of the disclosure will be described with reference to the drawings. A system of the second embodiment uses substantially the same hardware configuration as that of the first embodiment, and is realized by causing the control device 30 to execute a routine shown in FIG. 11 that will be described later.

In the system of the second embodiment, when automatic stop conditions are satisfied during operation of the engine 10, the control device 30 automatically stops the engine 10 after bringing it into the reduced-cylinder state, when the engine 10 is not in the reduced-cylinder state in which the reduced-cylinder operation is executed.

Figure 11:
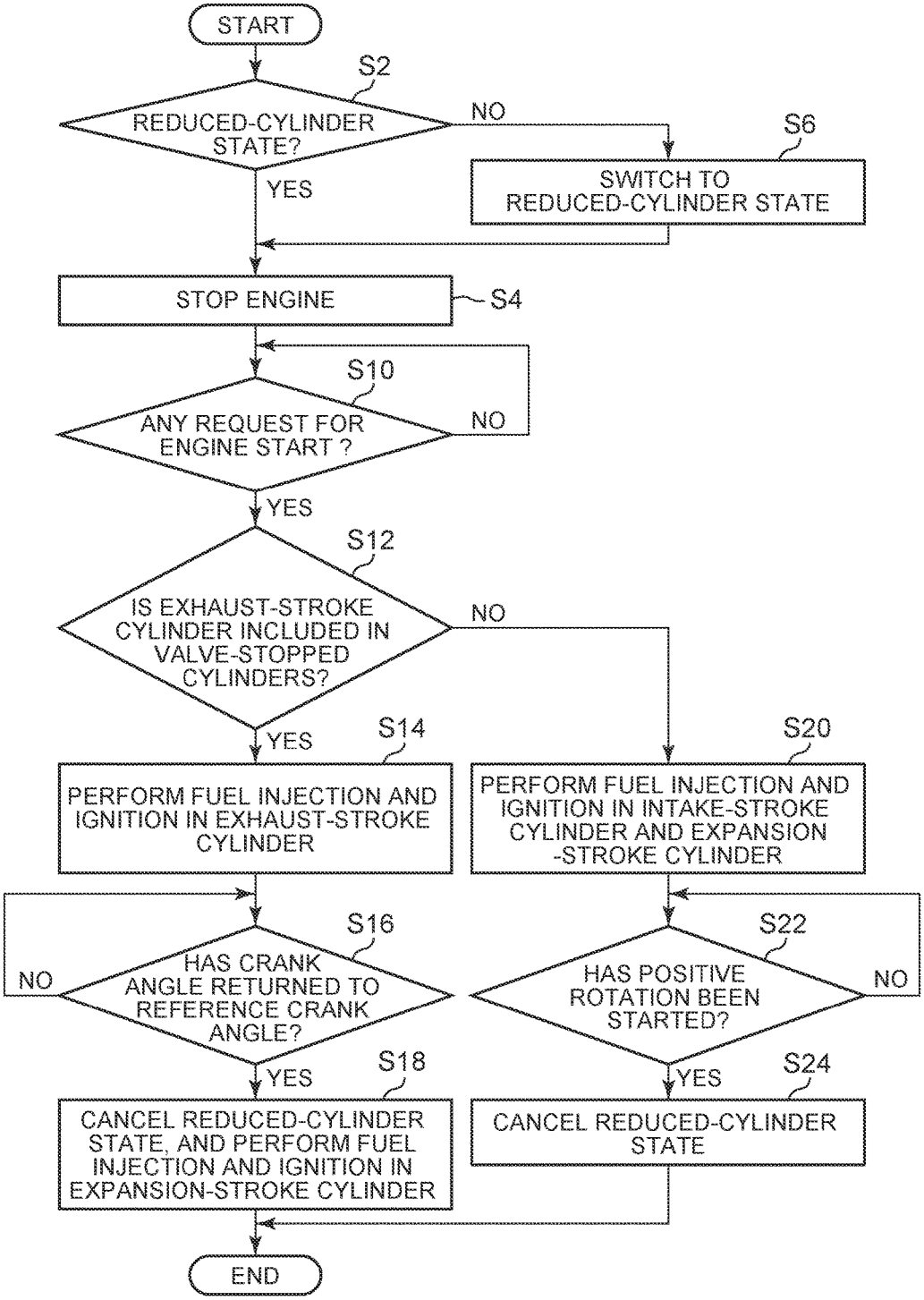
FIG. 11 is a flowchart illustrating a control routine executed by a control device according to a second embodiment of the disclosure.

Next, specific processing of ignition start control executed by the system of the second embodiment will be described with reference to FIG. 11. FIG. 11 is a flowchart illustrating a control routine executed by the control device 30 in the second embodiment. The routine shown in FIG. 11 is executed when the automatic stop conditions are satisfied during operation of the engine 10.

In the control routine shown in FIG. 11, it is initially determined whether the engine 10 is in the reduced-cylinder state (step S2). As a result, if it is determined that the engine 10 is in the reduced-cylinder state, the control proceeds to the next step, in which operation of the engine 10 is stopped while the reduced-cylinder state is maintained (step S4). On the other hand, if it is determined in the above step S2 that the engine 10 is not in the reduced-cylinder state, the control proceeds to the next step, in which the engine 10 is brought into the reduced-cylinder state (step S6). Once step S6 is executed, the control proceeds to the above step S4, in which operation of the engine 10 is stopped while the reduced-cylinder state is maintained. The operation of steps S10 through S24 in FIG. 11 is substantially the same as the operation of steps S10 through S24 in the routine of FIG. 7.

Thus, according to the system of the second embodiment, when operation of the engine 10 is automatically stopped under idle stop control, the engine 10 can be reliably started by ignition from the condition where operation of the engine 10 is stopped, even when the reduced-cylinder operation is not executed.

What is claimed is:

1. A control device for an internal combustion engine including a plurality of cylinders that are divided into a first cylinder group and a second cylinder group, the first cylinder group including cylinders of which ignition orders are not next to each other, the second cylinder group including cylinders of which ignition orders are not next to each other, a fuel injection device configured to execute fuel injection in each of the plurality of cylinders, an ignition device configured to execute ignition in each of the plurality of cylinders, and a cylinder reduction mechanism configured to hold intake valves and exhaust valves of the first cylinder group in closed states so as to establish a reduced-cylinder state, the control device comprising:

an electronic control unit configured to:

(i) execute reduced-cylinder operation by halting fuel injection and ignition in the cylinders of the first cylinder group in the reduced-cylinder state during operation of the internal combustion engine;

(ii) start the internal combustion engine by ignition, by executing fuel injection and ignition in an expansion-stroke cylinder as a cylinder on an expansion stroke, when the internal combustion engine is stopped in the reduced-cylinder state;

(iii) when the first cylinder group includes an exhaust-stroke cylinder as a cylinder on an exhaust stroke when the internal combustion engine is started by ignition, execute fuel injection and ignition in the expansion-stroke cylinder, after moving a piston in a reverse direction through fuel injection and ignition in the exhaust-stroke cylinder, and cancel the reduced-cylinder state, so as to start the internal combustion engine by ignition; and (iv) when the first cylinder group does not include the exhaust-stroke cylinder, move the piston in a positive direction through fuel injection and ignition in the expansion-stroke cylinder and a cylinder on an intake stroke of the first cylinder group, and then cancel the reduced-cylinder state, so as to start the internal combustion engine by ignition.

2. The control device for the internal combustion engine according to claim 1, wherein the electronic control unit is configured to execute fuel injection and ignition in the expansion-stroke cylinder, after moving the piston of the expansion-stroke cylinder to a position corresponding to a reference crank angle, through fuel injection and ignition in the exhaust-stroke cylinder, when the electronic control unit determines that the exhaust-stroke cylinder is included in the first cylinder group.

3. The control device for the internal combustion engine according to claim 1, wherein the electronic control unit is configured to:

(i) automatically stop operation of the internal combustion engine when an automatic stop condition is satisfied during operation of the internal combustion engine; and (ii) stop the internal combustion engine after switching the internal combustion engine to operation in the reduced-cylinder state, when the internal combustion engine is not in the reduced-cylinder state when the automatic stop condition is satisfied.

* * * * *